US006209159B1

(12) United States Patent
Murphy

(10) Patent No.: US 6,209,159 B1
(45) Date of Patent: Apr. 3, 2001

(54) PRESSURE REDUCING CUSHION WITH SELECTIVE PRESSURE POINT RELIEF

(75) Inventor: Michael Murphy, LaCrosse, WI (US)

(73) Assignee: Comfortex Health Care Surfaces, Winona, MN (US)

( * ) Notice: Subject to any disclaimer, the term of this patent is extended or adjusted under 35 U.S.C. 154(b) by 0 days.

(21) Appl. No.: 08/781,214

(22) Filed: Jan. 10, 1997

(51) Int. Cl.[7] ..... A47C 27/10; A47C 27/14

(52) U.S. Cl. ..... 5/654; 5/709; 5/723; 297/452.41; 297/452.25

(58) Field of Search ..... 5/654, 653, 709, 5/723, 420; 297/452.41, 452.25, 284.3

(56) References Cited

U.S. PATENT DOCUMENTS

| | | | | |
|---|---|---|---|---|
| 2,434,641 | * | 1/1948 | Burns | 5/654 |
| 2,491,557 | | 12/1949 | Goolsbee . | |
| 2,627,302 | * | 2/1953 | Forsyth | 5/654 |
| 3,428,974 | | 2/1969 | Stuart . | |
| 3,600,727 | | 8/1971 | Williams . | |
| 3,644,950 | | 2/1972 | Lindsay, Jr. . | |
| 3,872,525 | * | 3/1975 | Lea et al. | 5/709 |
| 4,017,118 | | 4/1977 | Cawley | 297/284 |
| 4,688,283 | | 8/1987 | Jacobson et al. | 5/709 |
| 4,706,313 | | 11/1987 | Murphy . | |
| 4,753,480 | * | 6/1988 | Morell | 5/654 |
| 4,788,730 | * | 12/1988 | Bexton | 5/654 |
| 4,796,948 | * | 1/1989 | Paul et al. | 5/654 |
| 5,033,133 | | 7/1991 | Nissen | 5/709 |
| 5,144,705 | | 9/1992 | Rogers | 5/654 |
| 5,163,737 | * | 11/1992 | Navack et al. | 5/653 |
| 5,193,237 | | 3/1993 | Holdredge | 5/654 |
| 5,303,435 | | 4/1994 | Haar et al. | 5/420 |
| 5,596,781 | * | 1/1997 | Graebe | 5/654 |
| 5,634,224 | * | 6/1997 | Gates | 5/709 |

* cited by examiner

*Primary Examiner*—Alexander Grosz
(74) *Attorney, Agent, or Firm*—Oblon, Spivak, McClelland, Maier & Neustadt, P.C.

(57) ABSTRACT

A pressure reducing cushion with selective pressure point relief features at least two air bladders, and a foam outer layer covering the air bladders. Each air bladder consists of an impervious to air sheet material which surrounds an open celled compressible foam material. Attached to the air bladder is an air flow tube and attached to the air flow tube is a flow control element. When the flow control element is open air from the atmosphere is able to communicate with the interior of the open celled compressible foam material through the air flow tube in combination with the flow control element. The open celled compressible foam material is of such a characteristic that once it is deformed it tends to regain its original shape, thus filling the air bladder with air, if the flow control element is open. Such a structure allows the cushion to be adjusted for maximum firmness, by not allowing air to leave the air bladders; minimum firmness is achieved by leaving the flow control element open, thus allowing air to be expelled from the air bladder; and selective pressure point relief is achieved by expelling air from an air bladder, closing its flow control element to prevent re-inflation, and allowing adjacent air bladders to be either filled with air and closing their flow control elements for maximum surrounding support, or left open for a more flotation-like support.

10 Claims, 6 Drawing Sheets

PRESSURE REDUCING CUSHION WITH SELECTIVE PRESSURE POINT RELIEF

BACKGROUND OF THE INVENTION

1. Field of the Invention

This invention concerns cushioning pads used in the field of health care to provide pressure reduction for the patient. The invention more particularly concerns cushion pads for patient care in wheelchairs, recliners, and other chairs used by patients in a health care environment.

2. Discussion of the Background

Previously existing cushioning pads have a number of shortcomings which can result in patient discomfort, and in a prolonged recovery period for the patient. Ideally, cushioning pads provide the lowest possible pressure on the supported surface of the patient and are able to substantially eliminate the pressure on the supported surface at selected locations on the patient.

One prior art device (Jacobson et al., U.S. Pat. No. 4,688,283) is constructed of a plurality of airtight air bladders each filled with foam material. Each air bladder is in contact with adjacent air bladders. The characteristic of the foam material is such that if it is compressed it will expand on its own, thus filling the bladder with air. Each air bladder has a valve connected to it, to individually regulate the amount of air that can flow into the air bladder. However, it produces an abrupt transition zone between an air bladder that is fully pressurized and an adjacent one that is completely evacuated, which creates patient discomfort.

Another prior art construction (Williams, U.S. Pat. No. 3,600,727) is similar to the prior art construction discussed above, but instead being filled with air, the air bladder is filled with a liquid. The bladders filled with a liquid tend to conduct body heat away from the patient which reduces blood flow and hence reduces the ability of the body to heal itself. Furthermore, this prior art construction contains all the disadvantages of the device described above, namely that the patient experiences discomfort due to the abrupt transition zone between pressurized and unpressurized fluid bladders.

Another prior art construction (Navach et al., U.S. Pat. No. 5,163,737) consists of a seat cushion and a backrest cushion. The seat cushion portion consists of a plurality of airtight, air bladders filled with a foam material. Adjacent air bladders are not in contact with each other. The air bladders are covered with a flexible polymer upholstery layer. Additionally this prior art construction contains an air valve for each air bladder to restrict the flow of air into and out of its respective air bladder. However, this prior art construction requires the use of an external pump or compressor to fill air bladders with air.

Thus, there is a need for a simple to use cushioning device that applies a substantially uniform pressure to the patient and which can selectively reduce the pressure at a point on the patient's body.

SUMMARY OF THE INVENTION

It is an object of the invention to provide a cushioning device that applies a substantially uniform pressure to the supported surface of a patient's body and which can also selectively reduce the pressure at a point on the patient's body.

In one form of the invention the pressure reducing cushion with selective pressure point relief takes the form of a cushion consisting of at least two air bladders which are covered with a foam outer layer. The air bladders are filled with an open celled compressible foam material. Each air bladder is connected to an air flow control element, which independently regulates the flow of air into and out of each air bladder.

In yet another form of the invention the pressure reducing cushion with selective pressure point relief takes the form of a cushion consisting of at least two air bladders attached to a cushion base layer, which are covered with a foam outer layer. The outer surface of the foam outer layer is surrounded by a cushion cover. The air bladders are filled with an open celled compressible foam material; and adjacent air bladders are in contact with each other. Each air bladder is connected to an air flow control element, which independently regulates the flow of air into and out of each air bladder.

In still another form of the invention the pressure reducing cushion with selective pressure point relief takes the form of a cushion consisting of at least two air bladders which are covered with a means for providing a reduction of any abrupt pressure transition between inflated and uninflated air bladders. The air bladders are filled with an open celled compressible foam material. Each air bladder is provided with a means for independently regulating the flow of air into and out of each air bladder.

Thus, Applicant's invention is superior to the prior art. Applicant's invention provides a cushioning device that produces a substantially uniform pressure on the supported surface of a patient and which can also selectively reduce the pressure at a point on the patient's surface, by using a foam outer layer in conjunction with the air bladders to achieve the desired objectives. The prior art fails to disclose the use of a foam outer layer covering air bladders, which provides the desired result. Furthermore, the prior art fails to disclose the use of a foam outer layer covering air bladders that are in contact with adjacent air bladders, which provides superior results. Such structural features distinguish Applicant's invention, structurally and functionally, over the prior art of Jacobson et al, Williams, and Navach et al.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
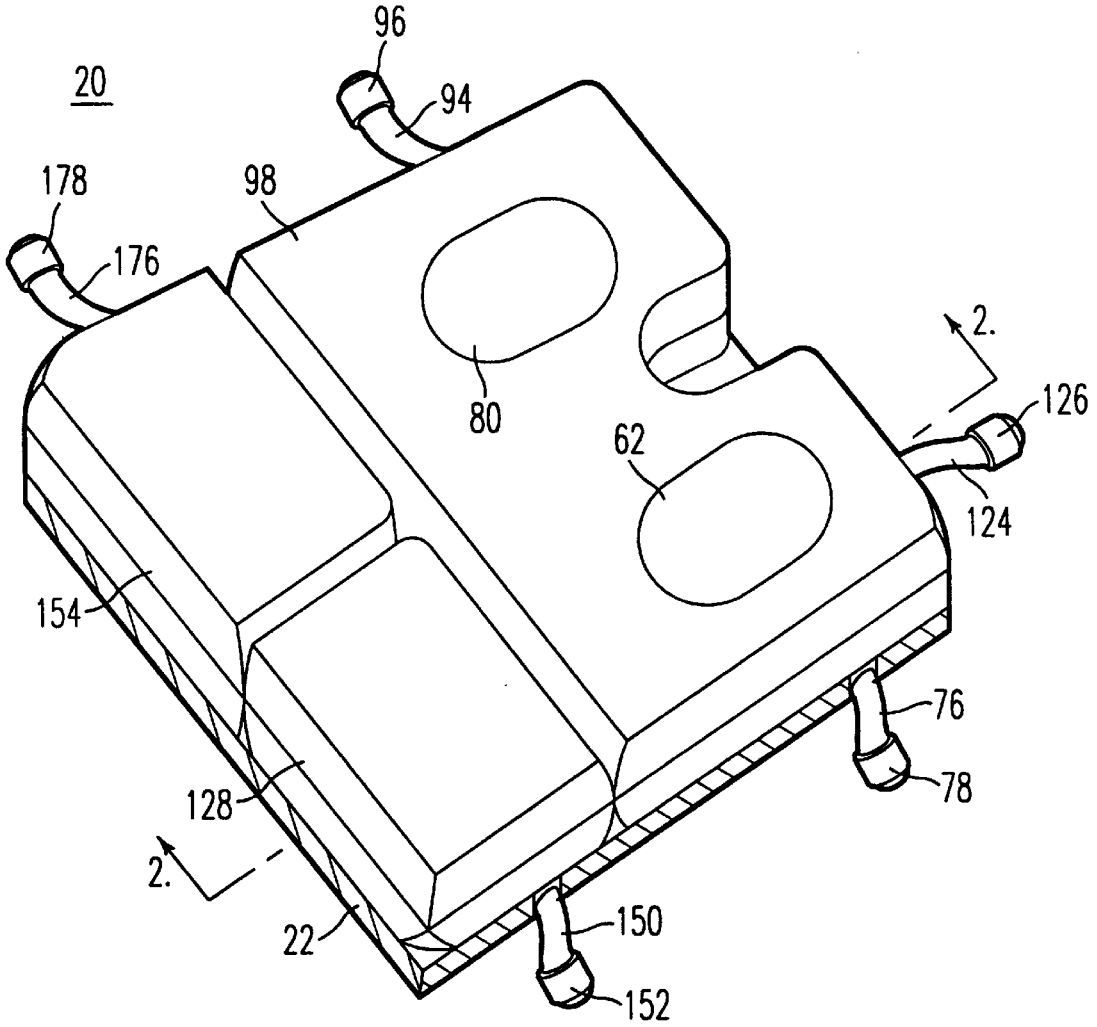
FIG. 1 is a perspective view of a seat cushion with the foam outer layer removed and with the seat cushion cover removed, showing the seat cushion air bladders, the flow control elements, and the seat cushion base layer.

Referring now to the drawings, wherein like reference numerals designate identical or corresponding parts throughout the several views, and more particularly to FIG. 1 thereof, A seat cushion 20 has been created which provides for pressure reduction and selective pressure point relief on the surface of the patient. The embodiment of this invention is displayed in FIGS. 1, 2, and 3. FIG. 1 is a perspective view of the seat cushion 20 with the foam outer layer 180 removed and the seat cushion cover 186 removed, showing the placement of the parts. FIG. 1 illustrates the seat cushion base layer 22 to which are attached seat cushion air bladders: the rear seat cushion air bladder 98, the rear left seat cushion air bladder 62, the rear right seat cushion air bladder 80, the front left seat cushion air bladder 128, and the front right seat cushion air bladder 154. As shown in FIGS. 1 and 3, the rear left seat cushion air bladder 62 is inserted into a cavity 114 provided for in the rear seat cushion air bladder 98, and the rear right seat cushion air bladder 80 is inserted into a cavity 112 which is provided for in the rear seat cushion air bladder 98, the front right seat cushion air bladder 154 is attached to the seat cushion base layer top side 24 near the corner defined by the seat cushion base layer front side 28 and the seat cushion base layer right side 30 and is in contact with the rear seat cushion air bladder 98 and the front left seat cushion air bladder 128, the front left seat cushion air bladder 128 is attached to the seat cushion base layer top side 24 near the corner defined by the seat cushion base layer front side 28 and the seat cushion base layer left side 26 and is in contact with the rear seat cushion air bladder 98 and the front right seat cushion air bladder 154. The air bladders are attached to the substantially rigid cushion base layer so as to maintain their relative positions. The air bladders are sized, shaped and arranged relative to one another so as to provide support for the uneven body surface contours of a single individual.

FIG. 1 further illustrates an air flow tube 76 connected to the rear left seat cushion air bladder 62 and a flow control element 78 connected to the air flow tube 76, an air flow tube 94 connected to the rear right seat cushion air bladder 80 and a flow control element 96 connected to the air flow tube 94, an air flow tube 124 connected to the rear seat cushion air bladder 98 and a flow control element 126 connected to the air flow tube 124, an air flow tube 150 connected to the front left seat cushion air bladder 128 and a flow control element 152 connected to the air flow tube 150, and an air flow tube 176 connected to the front right seat cushion air bladder 154 and a flow control element 178 connected to the air flow tube 176.

Figure 2:
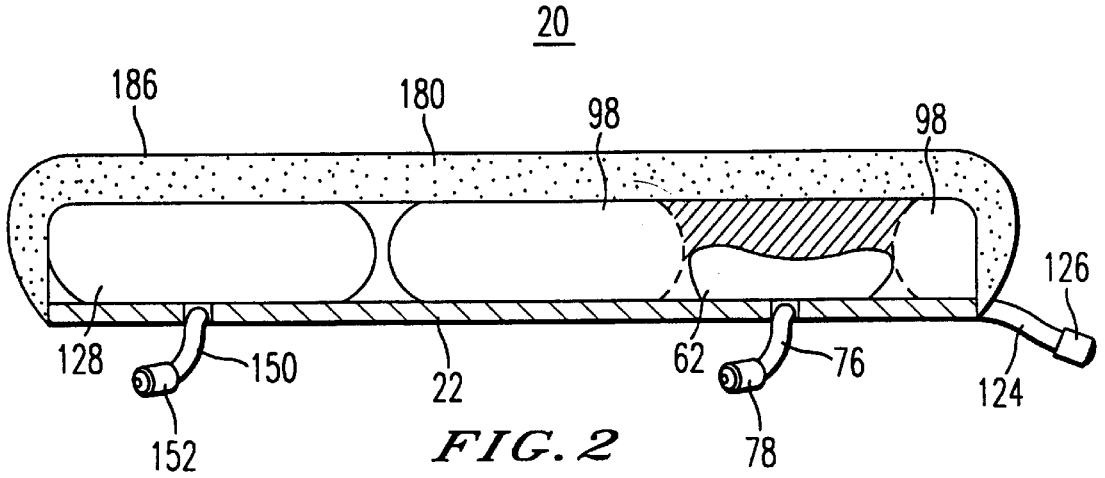
FIG. 2 is a partial cross-sectional view taken along the line 2—2 of FIG. 1, showing some of the elements interior of the cushion, and also showing the foam outer layer.
Figure 3:
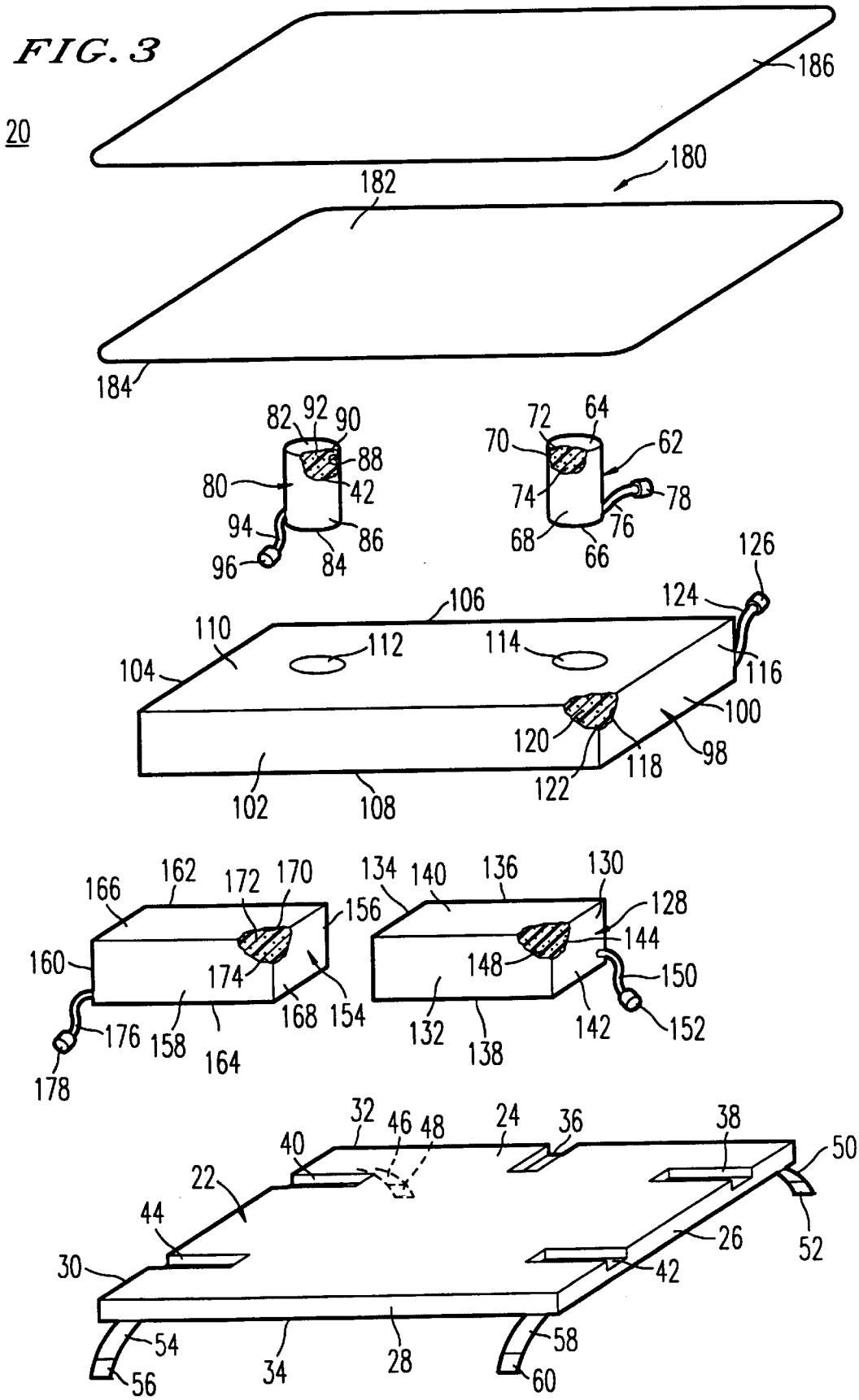
FIG. 3 is an exploded, perspective view of the seat cushion.

FIG. 2 is a partial cross-sectional view taken along section line 2—2 of FIG. 1. FIG. 2 displays the use of the foam outer layer 180 covering the top sides of the seat cushion air bladders 64, 82, 110, 140, 166, and the rear seat cushion air bladder rear side 106, the rear seat cushion air bladder left side 100, the rear seat cushion air bladder right side 104, the front left seat cushion air bladder left side 130, the front left seat cushion air bladder front side 132, the front right seat cushion air bladder front side 158, and the front right seat cushion air bladder right side 160. FIG. 2 further illustrates the use of the seat cushion cover 186 which envelops the foam outer layer outer surface 182. Further, FIG. 2 shows the front left seat cushion air bladder 128 in an expanded state, the rear seat cushion air bladder 98 in an expanded state, and the rear left seat cushion air bladder 62 in a compressed state.

FIG. 3 is an exploded pictorial view of the seat cushion 20. Illustrated in FIG. 3 is the seat cushion base layer 22 which contains a rear seat cushion air bladder channel 36, a rear left seat cushion air bladder channel 38, a rear right seat cushion air bladder channel 40, a front left seat cushion air bladder channel 42, and a front right seat cushion air bladder channel 44. Attached to the seat cushion base layer 22 are a rear right seat cushion fabric strip 46 attached near the seat cushion base layer rear side 32 and near the seat cushion base layer right side 30 towards the seat cushion base layer bottom side 34 and attached to the rear right seat cushion fabric strip 46 is a rear right seat cushion fabric strip fastener means 48, a rear left seat cushion fabric strip 50 attached near the seat cushion base layer rear side 32 and near the seat cushion base layer left side 26 towards the seat cushion base layer bottom side 34 and attached to the rear left seat cushion fabric strip 50 is a rear left seat cushion fabric strip fastener means 52, a front right seat cushion fabric strip 54 connected near the seat cushion base layer front side 28 near the seat cushion base layer right side 30 towards the seat cushion base layer bottom side 34 and attached to the front right seat cushion fabric strip 54 is a front layer seat cushion fabric strip fastener mean 56, and a front left seat cushion fabric strip 58 connected near the seat cushion base layer front side 28 and near the seat cushion base layer left side 26 towards the seat cushion base layer bottom side 34 and attached to the front left seat cushion fabric strip 58 is a front left seat cushion fabric strip fastener means 60.

The rear seat cushion air bladder 98 is illustrated in FIG. 3 showing its left side 100, front side 102, right side 104, rear side 106, bottom side 108, top side 110, and having a rear right seat cushion air bladder cavity 112 and a rear left seat cushion air bladder cavity 114. The interior region 118 is filled with an open celled compressible foam material 122. Connected to the rear seat cushion air bladder 98 is an airflow tube 124, and a flow control element 126 is connected to the airflow tube 124. The rear seat cushion air bladder bottom side 108 is attached to the seat cushion base layer top side 24 such that the rear seat cushion air bladder air flow tube 124 is situated in the seat cushion base layer rear seat cushion air bladder channel 36.

The rear left seat cushion air bladder 62 has a top side 64, a bottom side 66, an exterior surface 68, and an interior region 70 which is filled with an open celled compressible foam material 74. The rear left seat cushion air bladder 62 is situated in the rear left seat cushion air bladder cavity 114 and the rear left seat cushion air bladder air flow tube 76 is situated in the rear left seat cushion air bladder channel 38, the rear left seat cushion air bladder exterior surface 68 is in contact with the exterior surface 116 of the rear seat cushion air bladder 98, and the rear left seat cushion air bladder bottom side 66 is in contact with the seat cushion base layer top side 24.

The rear right seat cushion air bladder 80 has a top side 82, a bottom side 84, an exterior surface 86, and an interior region 88 which is filled with an open celled compressible foam material 92. The rear right seat cushion air bladder 80 is situated in the rear right seat cushion air bladder cavity 112 and the rear right seat cushion air bladder air flow tube 94 is situated in the rear right seat cushion air bladder channel 40; the rear right seat cushion air bladder exterior surface 86 is in contact with the exterior surface 116 of the rear seat cushion air bladder 98, and the rear right seat cushion air bladder bottom side 84 is in contact with the seat cushion base layer top side 24.

The front left seat cushion air bladder 128 has a left side 130, a front side 132, a right side 134, a rear side 136, a bottom side 138, and a top side 140, and an interior region 144 which is filled with an open celled compressible foam material 148. Connected to the front left seat cushion air bladder 128 is an air flow tube 150, and a flow control element 152 is connected to the air flow tube 150. The front left seat cushion air bladder bottom side 138 is attached to the seat cushion base layer top side 24, the front left seat cushion air bladder rear side 136 is in contact with the rear seat cushion air bladder front side 102, and the front left seat cushion air bladder right side 134 is in contact with the front right seat cushion air bladder left side 156, and the front left seat cushion air bladder air flow tube 150 is situated in the front left seat cushion air bladder channel 42.

The front right seat cushion air bladder 154 has a left side 156, a front side 158, a right side 160, a rear side 162, a bottom side 164, a top side 166, and an interior region 170 which is filled with an open celled compressible foam material 174. Connected to the front right seat cushion air bladder 154 is an airflow tube 176, and a flow control element 178 is connected to the airflow tube 176. The front right seat cushion air bladder bottom side 164 is in contact with the seat cushion base layer top side 24, the front right seat cushion air bladder left side 156 is in contact with the front left seat cushion air bladder right side 134, the front right seat cushion air bladder rear side 162 is in contact with the rear seat cushion air bladder front side 102, and the front right seat cushion air bladder air flow tube 176 is situated in the front right seat cushion air bladder channel 44.

A foam outer layer 180, has an outer surface 182 and an inner surface 184, covers the exposed surfaces of the seat cushion air bladders and the seat cushion base layer which includes: the seat cushion base layer left side 26, the seat cushion base layer front side 28, the seat cushion base layer right side 30, the seat cushion base layer rear side 32, the rear left seat cushion air bladder top side 64, the rear right seat cushion air bladder top side 82, the rear seat cushion air bladder top side 110, the rear seat cushion air bladder left side 100, the rear seat cushion air bladder right side 104, the rear seat cushion air bladder rear side 106, the front left seat cushion air bladder left side 130, the front left seat cushion air bladder top side 140, the front left seat cushion air bladder front side 132, the front right seat cushion air bladder front side 158, the front right seat cushion air bladder front side 160, the front right seat cushion air bladder top side 166. A seat cushion cover 186 envelopes the seat cushion foam outer layer outer surface 182.

The seat cushion base layer 22 is preferably made of a rigid, waterproof, closed cell, polyurethane foam material. The foam outer layer 180 is preferably made of a soft, highly resilient foam material such as polyurethane or a vaso-elastic material, having a thickness between 1 inch and 1.5 inches, a density of 2.4 pounds per cubic foot, and an Indentation Force Deflection in the range of 15 to 18 pounds. The seat cushion cover 186 is preferably made of a flexible fabric such as nylon, nylon spandex, cotton-Lycra, or cotton-spandex, which is water proof, water repellant, or breathable cloth and may be laminated with a polyurethane foam material. The open celled compressible foam material 74, 92, 122, 148, and 174, of the seat cushion air bladders 62, 80, 98, 128, and 154, is preferably made of an open celled polyurethane foam material and is dye-cut into the preferred shapes, having a thickness of 1.5 inches, a density of 1.8 pounds per cubic foot, and an Indentation Force Deflection in the range of 35 to 45 pounds. The seat cushion air bladder exterior surfaces 68, 86, 116, 142, and 168, are preferably made of an impervious to air vinyl or urethane sheeting material. These seat cushion air bladders 62, 80, 98, 128, and 154, are constructed by, but not limited to, heat sealing the vinyl or urethane sheeting material that comprises the exterior surfaces 68, 86, 116, 142, and 168, of the seat cushion air bladders 62, 80, 98, 128, and 154, around the dye-cut open celled polyurethane foam material sections 74, 92, 122, 148, and 174, creating a unified body of independent seat cushion air bladders. The seat cushion air bladders 62, 80, 98, 128, and 154, are secured to the seat cushion base layer 22 through use of an adhesive glue. The seat cushion fabric strip fastener means 48, 52, 56, and 60, are preferably constructed of snaps, full width zippers, or hook fastening elements which become embedded in loop fastening elements. The fastenings of this type, hook and loop, are marketed under the trademark "VELCRO." The air flow control elements 78, 96, 126, 152, and 178, are preferably constructed of an open and close valve.

The seat cushion air bladders 62, 80, 98, 128, and 154, are connected to their respective air flow tubes 76, 94, 124, 150, and 176, in such a way that when the air bladder is compressed, air is expelled from the seat cushion air bladder through the respective air flow tube and through the respective flow control element. When pressure is removed or reduced from the seat cushion air bladders 62, 80, 98, 128, and 154, the respective open celled compressible foam materials 74, 92, 122, 148, and 174, in an effort to return to its normal shape, provides the force to draw air in through the respective air flow tube 76, 94, 124, 150, and 176, and through the respective flow control elements 78, 96, 126, 152, and 178, to refill the seat cushion air bladders 62, 80, 98, 128, and 154, with air.

The seat cushion 20 provides pressure reduction since the seat cushion air bladders 62, 80, 98, 128, and 154, are in contact with each other, thus maximizing the surface area of the seat cushion 20 which is supported by air bladders. If gaps were present between the air bladders attached to the seat cushion base layer 22 then a smaller surface area would support the patient, thus resulting in a larger contact pressure on the patient's supported surface. The seat cushion 20 may be placed on any surface such as a wheelchair, a recliner, or any other chair. The soft, resilient seat cushion foam outer layer 180 also provides the patient with a surface that helps to distribute the pressure. Each seat cushion air bladder 62, 80, 98, 128, and 154, are individually controlled due to their respective flow control elements 78, 96, 126, 152, and 178, to be adjusted for the patient's comfort, and wound treatment. The seat cushion air bladders 62, 80, 98, 128, and 154, are adjusted by compressing the selected seat cushion air bladder while its respective flow control element is in an open state so that air may flow out of the selected seat cushion air bladder through the respective seat cushion air bladder air flow tube and out the respective seat cushion air bladder flow control element into the atmosphere, at the desired depth of compression the respective seat cushion air bladder flow control element is closed; thus preventing the selected seat cushion air bladder from expelling air or being filled with air.

In another mode of operation a selected seat cushion air bladder or all seat cushion air bladders may have their respective flow control elements 78, 96, 126, 152, and 178, left in the open position, thus providing "floatation". Floatation provides for large deflections of the surface of the seat cushion 20. When the patient sits on the seat cushion 20 the seat cushion air bladders underneath the patient become compressed, thus expelling air from the effected seat cushion air bladders to the atmosphere. When the patient moves, leans, gets up, or repositions themselves the effected seat cushion air bladders will either expand, if pressure has been removed from them, or become compressed, if pressure has been applied to them. In the flotation mode, the support pressure reacted on the patient's surface is provided by the spring rate of the open celled compressible foam material of the seat cushion air bladders 74, 92, 122, 148, and 174. This mode of operation provides for a large cushioning effect.

As an example of the selective pressure point relief that can be provided by using the seat cushion 20 it will be shown how such relief will be provided to the left ischial tuberosity of the patient. Covering the seat cushion air bladders 62, 80, 98, 128, and 154, are the seat cushion top layer 180 and the seat cushion cover 186. The combined use of the seat cushion foam outer layer 180 and the seat cushion cover 186 provides a soft and comfortable surface for the patient to sit on. In this example, the rear left seat cushion air bladder flow control element 78 is opened, then the rear left seat cushion air bladder 62 is manually compressed expelling the contained air, the rear left seat cushion air bladder flow control element 78 is then closed off, then the flow control element of the adjacent seat cushion air bladder, the rear seat cushion air bladder 98 flow control element 126 is opened, the opened cell compressible foam material 122 of the rear seat cushion air bladder 98 is allowed to expand, thus filling the rear seat cushion air bladder 98 with air, and then the rear seat cushion air bladder flow control element 126 is closed. The seat cushion foam outer layer 180 which encases the seat cushion air bladders 62, 80, 98, 128, and 154, creates a gradual support pressure transition region. The gradual support pressure transition region spans from a location on top of the fully expanded rear seat cushion air bladder 98 and extends across the edge of that seat cushion air bladder to the region above the fully compressed rear left seat cushion air bladder 62 then across to the rear seat cushion air bladder 98 which is fully inflated. The portion of the seat cushion top layer 180 situated above the fully inflated rear seat cushion air bladder 98 provides full weight carrying ability, thus the pressure on the patient's surface is high. The portion of the seat cushion foam outer layer 180 spanning the edge between the fully inflated rear seat cushion air bladder 98 and the compressed rear left seat cushion bladder 62 provides a smooth transition into a region where the support pressure on the patient's surface reaches a minimum. Such a combination of inflated and deflated seat cushion air bladders results in selective pressure point relief underneath the patient's left ischial tuberosity. Such selective pressure point relief enhances wound healing and can help prevent the creation of sores. This is just one example of the selective pressure point relief that can be provided with the seat cushion 20, any combination of inflated and deflated seat cushion air bladders can be used to provide patient comfort and wound healing, while the bony prominence and surrounding tissue rest in a desirable position without excessive pressure.

All of the above-mentioned modes of operation are provided without the use of an external pump to either fill or evacuate the seat cushion air bladders 62, 80, 98, 128, and 154, with air.

Figure 4:
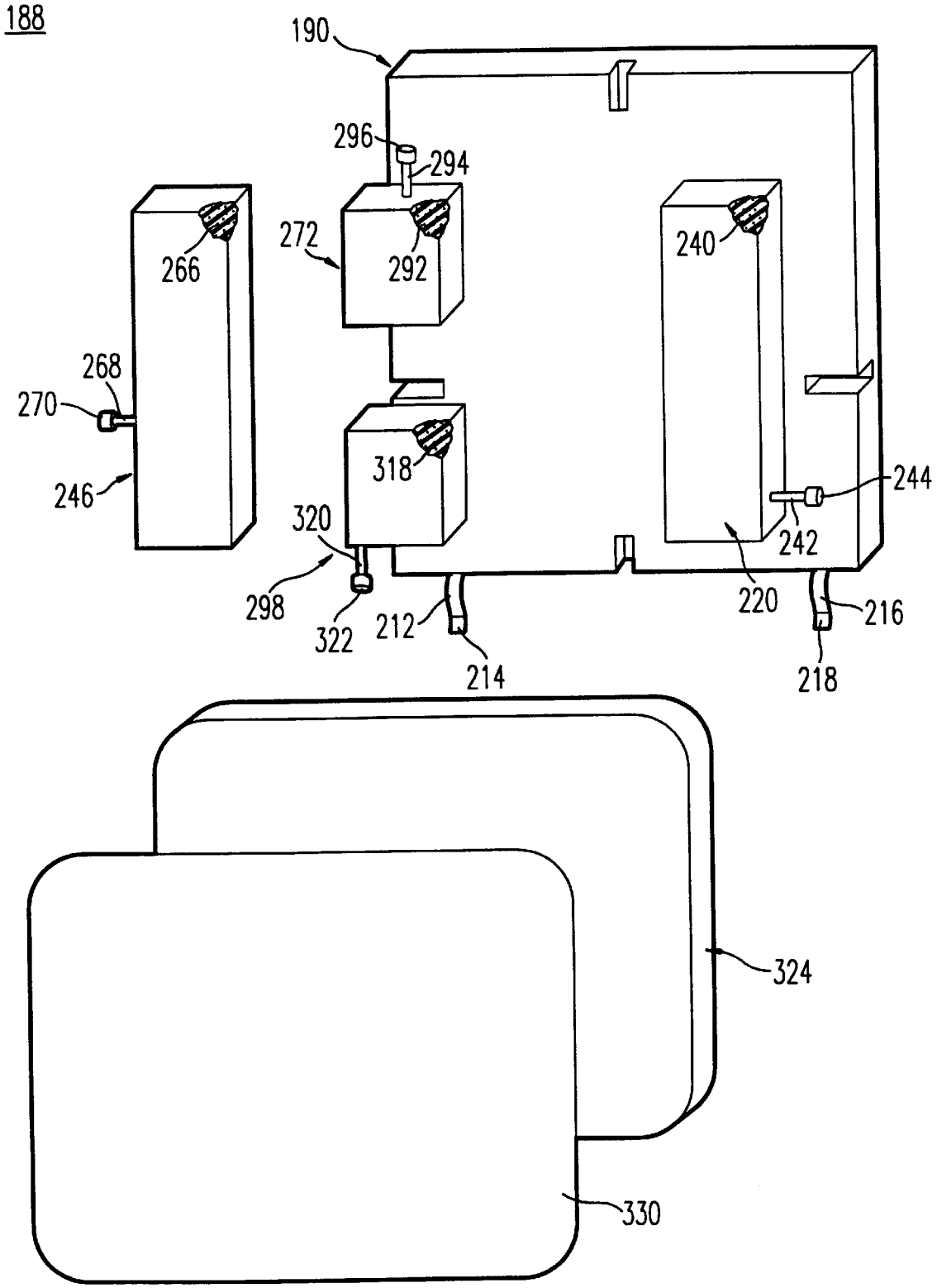
FIG. 4 is an exploded, perspective view of the backrest cushion.

In another embodiment of the invention a backrest cushion 188 has been created which provides for pressure reduction and selective pressure point relief on the surface of the patient's back. The embodiment of this invention is displayed in FIG. 4. FIG. 4 is an exploded pictorial view of the backrest cushion 188. Illustrated in FIG. 4 is the backrest cushion base layer 190, the right side backrest cushion air bladder 246, the left side backrest cushion air bladder 220, the upper center backrest cushion air bladder 272, the lower center backrest cushion air bladder 298, the foam outer layer 324, and the backrest cushion cover 330. Attached to the backrest cushion base layer 190 are a bottom right backrest cushion fabric strip 212, and a bottom left backrest cushion fabric strip 216. Attached to each backrest cushion fabric strip 212, 216, is a fabric strip fastener means 214, 218.

Each backrest cushion air bladder 246, 272, 298, and 220, is filled with an open celled compressible foam material 266, 318, 292, and 240, is connected to an airflow tube 268, 294, 320, and 242, and a flow control element 270, 296, 322, and 244, is attached to each airflow tube 268, 294, 320, and 242.

The construction and operation of the backrest cushion 188 is similar to that of the seat cushion 20. As such, it is believed that the structure and operation of the backrest cushion 188 have been fully disclosed.

Figure 5:
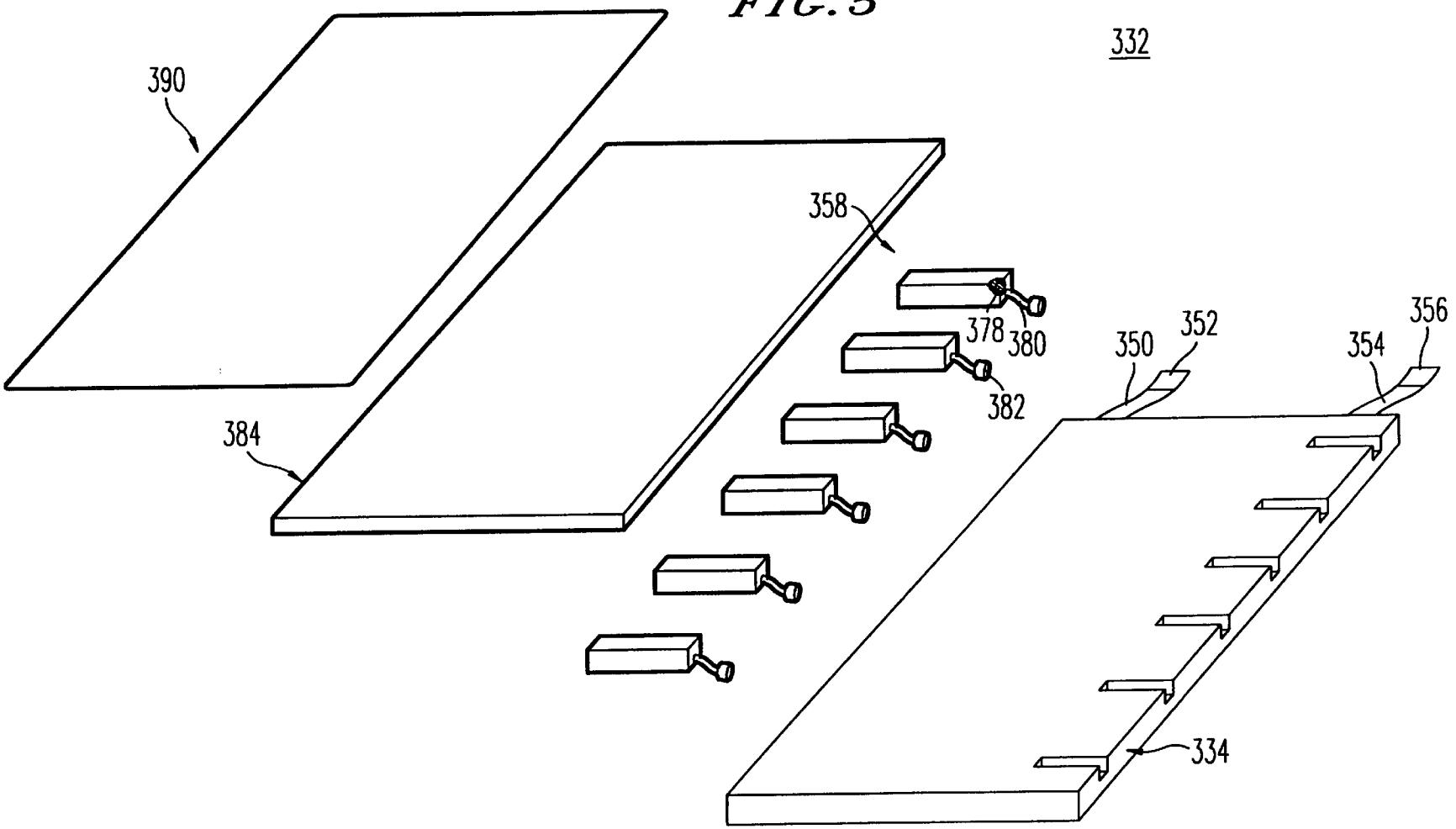
FIG. 5 is an exploded, perspective view of the leg-rest cushion.

In another embodiment of the invention, a leg-rest cushion 332 has been created which provides for pressure reduction and selective pressure point relief on the surface of the patient's legs. The embodiment of this invention is displayed in FIG. 5. FIG. 5 is an exploded pictorial view of the leg-rest cushion 332. Illustrated in FIG. 5 is the leg-rest cushion base layer 334, six identical substantially horizontal air bladders 358, the leg-rest cushion foam outer layer 384, and the leg-rest cushion cover 390.

Attached to the leg-rest cushion base layer 334 are a top right leg-rest cushion fabric strip 350, and a top left leg-rest cushion fabric strip 354. Attached to each leg-rest cushion fabric strip 350, 354, is a leg-rest cushion fabric strip fastener means 352, 356.

Each of the six leg-rest cushion air bladders is identical. Each leg-rest cushion air bladder 358 is filled with an open celled compressible foam material 378, is connected to an airflow tube 380, and a flow control element 382 is connected to the airflow tube 380.

The construction and operation of the leg-rest cushion 332 is similar to that of the seat cushion 20. As such, it is believed that the structure and operation of the leg-rest cushion 332 have been fully disclosed.

Figure 6:
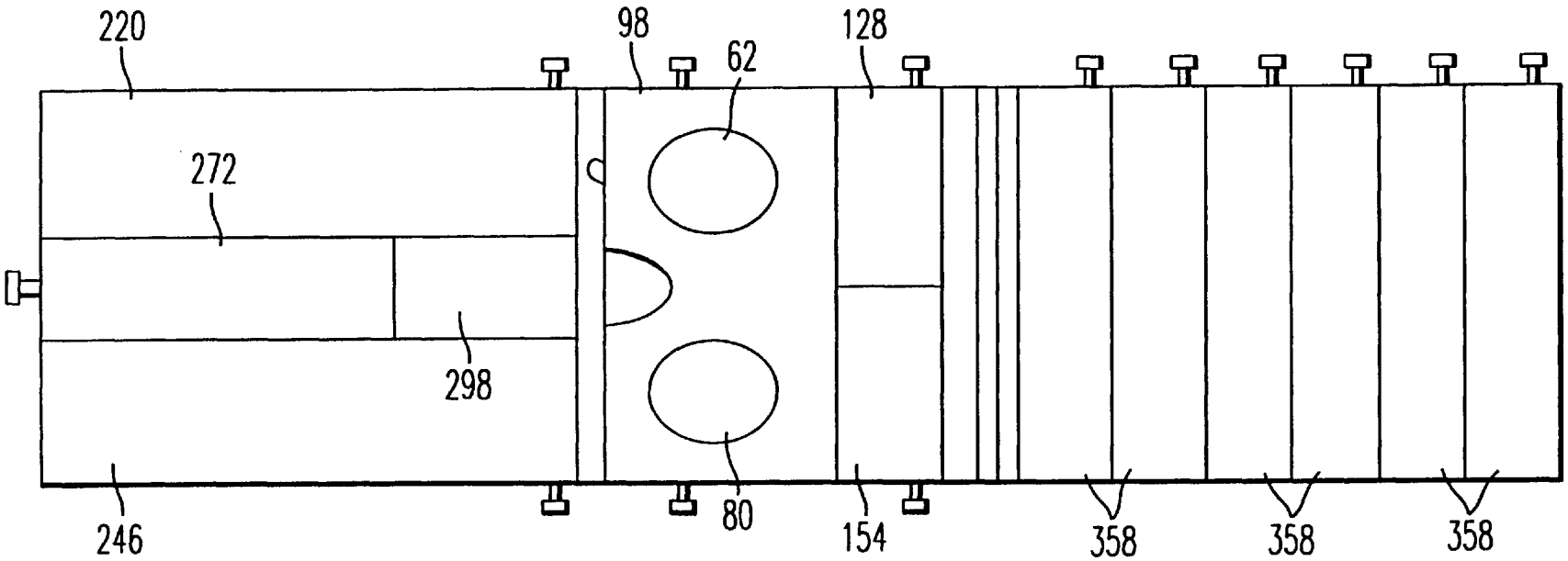
FIG. 6 is a top plan view of the combination of a leg-rest cushion, seat cushion, and a backrest cushion, all cushions having their respective outer layers removed and their respective covers removed.

FIG. 6 is a top plan view of the combination of a leg-rest cushion 332, a seat cushion 20, and a backrest cushion 188, all cushions having their respective foam outer layers removed and their respective covers removed. FIG. 6 further illustrates the locations of the air bladders 220, 246, 272, 298, 98, 62, 80, 128, 159, and 358.

Figure 7:
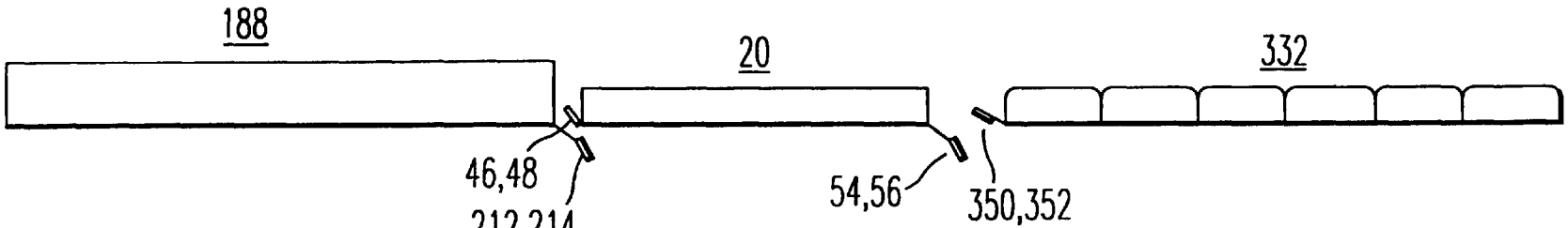
FIG. 7 is a side view of the leg-rest cushion, seat cushion, and backrest cushion combination.

FIG. 7 is a side view of FIG. 6, showing the leg-rest cushion 332, the seat cushion 20, and the backrest cushion 188 combination. Again, as in FIG. 6 the foam outer layers of the cushions are removed as are the respective covers. FIG. 6 additionally shows the right side cushion fabric strips 212, 46, 54, and 350 and their associated fastener means 214, 48, 56, and 352.

Figures 8, 9:
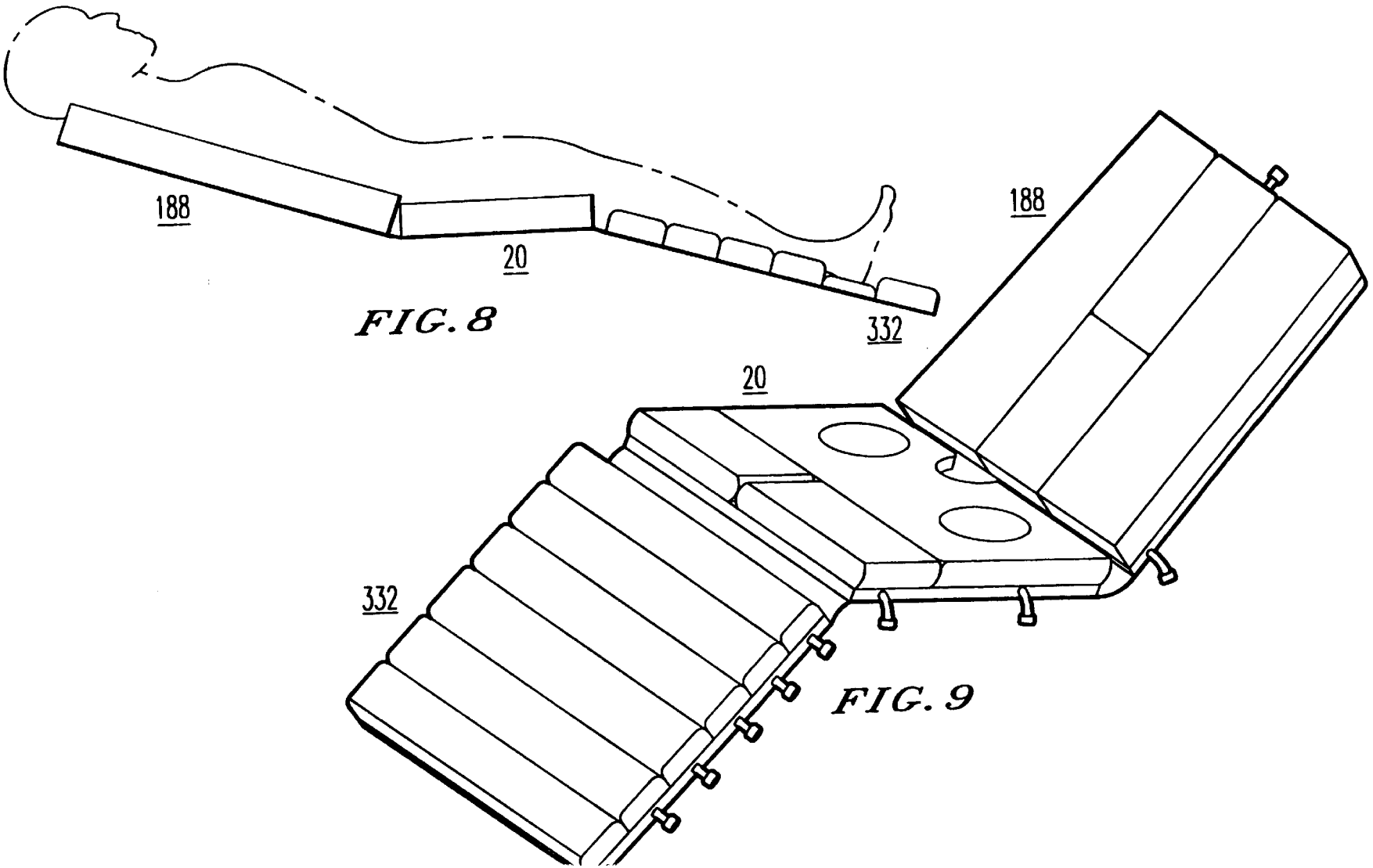
FIG. 8 is a side view of the leg-rest cushion, seat cushion, and backrest cushion combination, with respective covers and outer layers removed, shown in use to support a patient illustrated in phantom lines.
FIG. 9 is a perspective view of the leg-rest cushion, seat cushion, and backrest cushion in combination, with respective covers and outer layers removed.

FIG. 8, is a side view as in FIG. 7 showing the combination of a leg-rest cushion 332, a seat cushion 20, and a backrest cushion 188, with their respective covers and foam outer layers removed. FIG. 8 additionally shows a patient illustrated in phantom lines.

FIG. 9 is a perspective view of the leg-rest cushion 332, the seat cushion 20, and the backrest cushion 188 in combination, with their respective covers and foam outer layers removed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A seat cushion, which comprises:

a substantially rigid cushion base layer;

at least two air bladders in contact with adjacent air bladders, each air bladder attached to the substantially rigid cushion base layer so as to maintain relative positions of said at least two air bladders, said at least two air bladders being sized, shaped and arranged relative to one another so as to provide support for a single individual;

an open celled compressible foam material filling the interior of each said air bladder;

at least one air flow control element cooperating with each said air bladder to independently regulate the flow of air into and out of each air bladder, said flow control element comprises an open and close valve;

a foam outer layer covering said air bladders; and a cushion cover attached to the outer surface of the cushion outer layer.

2. A cushion as recited in claim 1, further comprising an air-flow tube connected between respective said at least two air bladders and said flow control elements, to provide fluidic communication between the air bladders and their respective flow control elements.

3. A cushion as recited in claim 1 wherein said open celled compressible foam material has a density of 1.8 pounds per cubic foot.

4. A cushion as recited in claim 1 wherein said open celled compressible foam material has an in Indentation Force Deflection of 35 to 45 pounds.

5. A cushion as recited in claim 1 wherein said foam outer layer has a density of 2.4 pounds per cubic foot.

6. A cushion as recited in claim 1 wherein said foam outer layer has an Indentation Force Deflection of 15 to 18 pounds.

7. A cushion as recited in claim 1 wherein said substantially rigid cushion base layer is made of a rigid, closed cell, foam material.

8. A cushion as recited in claim 1, further comprising a plurality of fabric strips attached to the substantially rigid cushion base layer, each fabric strip having a fastener means at its free end for fastening to other cushions.

9. A cushion as recited in claim 1 wherein said at least two air bladders each have a respective interior region and a respective outer surface, each air bladder being impervious to air, said interior region of each air bladder has a respective interior region surface, said open celled compressible foam material filling each seat cushion air bladder is heat sealed to the interior region surface of each respective air bladder.

10. A cushion for use as a seat cushion, which comprises:

at least two air bladders, said at least two air bladders contact adjacent air bladders, said at least two air bladders each have a respective interior region and a respective outer surface, each air bladder being impervious to air, said interior region of each air bladder has a respective interior region surface;

an open celled compressible foam material filling the interior of each said air bladder, said open celled compressible foam material filling each seat cushion air bladder is heat sealed to the interior region surface of each respective air bladder;

at least one air flow control element cooperating with each said air bladder to independently regulate the flow of air into and out of each air bladder;

a foam outer layer covering said air bladders;

a cushion base layer; and a plurality of fabric strips attached to the cushion base layer, each fabric strip having a fastener means at its free end for fastening to other cushions, wherein said at least two air bladders comprise a rear left seat cushion air bladder of said at least two air bladders attached to the cushion base layer; a rear right seat cushion air bladder of said at least two air bladders attached to the cushion base layer; a rear seat cushion air bladder of said at least two air bladders attached to the cushion base layer, having a rear right seat cushion air bladder cavity for the insertion of the rear right seat cushion air bladder and a rear left seat cushion air bladder cavity for the insertion of the rear left seat cushion air bladder; a front left seat cushion air bladder of said at least two air bladders attached to the cushion base layer; and a front right seat cushion air bladder of said at least two air bladders attached to the cushion base layer.

* * * * *